US010369395B2

(12) United States Patent
Bowen et al.

(10) Patent No.: US 10,369,395 B2
(45) Date of Patent: Aug. 6, 2019

(54) TRIMETHYLGLYCINE AS A FREEZE SUPPRESSANT IN FIRE FIGHTING FOAMS

(71) Applicant: Tyco Fire Products LP, Landsdale, PA (US)

(72) Inventors: Martina E. Bowen, Marinette, WI (US); Mark Adam-Christopher Siem, Menominee, MI (US); Stephen Aloysius Barker, Menominee, MI (US)

(73) Assignee: Tyco Fire Products LP, Lansdale, PA (US)

( * ) Notice: Subject to any disclaimer, the term of this patent is extended or adjusted under 35 U.S.C. 154(b) by 546 days.

(21) Appl. No.: 14/775,622

(22) PCT Filed: Mar. 14, 2014

(86) PCT No.: PCT/US2014/029276
§ 371 (c)(1),
(2) Date: Sep. 11, 2015

(87) PCT Pub. No.: WO2014/153140
PCT Pub. Date: Sep. 25, 2014

(65) Prior Publication Data

US 2016/0038779 A1 Feb. 11, 2016

Related U.S. Application Data

(60) Provisional application No. 61/786,002, filed on Mar. 14, 2013.

(51) Int. Cl.
*A62D 1/02* (2006.01)

(52) U.S. Cl.
CPC ..... *A62D 1/0085* (2013.01); *A62D 1/0071* (2013.01)

(58) Field of Classification Search
None
See application file for complete search history.

(56) References Cited

U.S. PATENT DOCUMENTS 3,047,619 A 7/1962 Brace
3,257,407 A 6/1966 Brace
3,258,423 A 6/1966 Tuve et al.
3,422,011 A 1/1969 Jackovitz et al.
3,457,172 A 7/1969 Stewart et al.
3,562,156 A 2/1971 Francen
3,579,446 A 5/1971 Kroke et al.
3,621,059 A 11/1971 Bartlett
3,655,555 A 4/1972 Rossmy et al.
3,661,776 A 5/1972 Fletcher et al.
3,677,347 A 7/1972 Rosen et al.
3,759,981 A 9/1973 Hager et al.
3,772,199 A 11/1973 Tamai et al.
3,789,265 A 1/1974 Holz et al.
3,828,085 A 8/1974 Price et al.
3,839,425 A 10/1974 Bartlett et al.
3,849,315 A 11/1974 Chiesa, Jr.
3,941,708 A 3/1976 Gentit et al.
3,952,075 A 4/1976 Nakamura et al.
3,957,657 A 5/1976 Chiesa, Jr.
3,957,658 A 5/1976 Chiesa et al.
3,963,776 A 6/1976 Middleton
4,038,198 A 7/1977 Wagner et al.
4,042,522 A 8/1977 Falk
4,049,556 A 9/1977 Tujimoto et al.
4,060,132 A 11/1977 Chiesa, Jr.
4,060,489 A * 11/1977 Chiesa, Jr. ..... A62C 99/0036 252/2
4,069,158 A 1/1978 Bertocchio et al.
4,090,976 A 5/1978 Dehollander et al.
4,099,574 A 7/1978 Cooper et al.
4,149,599 A * 4/1979 Chiesa, Jr. ..... A62D 1/0085 169/46
4,203,850 A 5/1980 Wirtz et al.
4,209,407 A 6/1980 Schuierer et al.
4,306,979 A 12/1981 Tsuji
4,387,032 A * 6/1983 Chiesa, Jr. ..... A62C 99/0036 169/44
4,420,434 A 12/1983 Falk
4,424,133 A 1/1984 Mulligan
4,464,267 A 8/1984 Chiesa et al.
5,079,036 A * 1/1992 Roe ..... B01J 2/30 106/13
5,207,932 A * 5/1993 Norman ..... A62D 1/0085 252/3
5,218,021 A 6/1993 Clark et al.
5,616,273 A 4/1997 Clark et al.
(Continued)

FOREIGN PATENT DOCUMENTS

CN 101 716 408 A 6/2010
WO WO 99/11729 A1 3/1999
(Continued)

OTHER PUBLICATIONS

International Search Report and Written Opinion, International Application No. PCT/US2014/029276 (published as WO 2014/153140) (dated Jul. 7, 2014).

*Primary Examiner* — Joseph D Anthony
(74) *Attorney, Agent, or Firm* — Foley & Lardner LLP

(57) ABSTRACT

Fire foam concentrates are provided that contain trimethyl glycine as a freeze suppressant, an effective amount of at least one anionic, zwitterionic or nonionic surfactant, and an effective amount of a foam stabilizing agent. Methods of preparing fire fighting foams from the concentrates, and methods of fighting fires using these foams, also are provided.

29 Claims, No Drawings

(56) References Cited

U.S. PATENT DOCUMENTS

| | | | | |
|---|---|---|---|---|
| 5,750,043 | A | 5/1998 | Clark | |
| 6,294,104 | B1 * | 9/2001 | Ilves | C09K 3/185 106/13 |
| 8,298,436 | B2 | 10/2012 | Michael | |
| 8,524,104 | B1 | 9/2013 | Michael | |
| 9,669,246 | B2 | 6/2017 | Bowen et al. | |
| 9,956,447 | B2 | 5/2018 | Martin et al. | |
| 9,956,448 | B2 | 5/2018 | Martin | |
| 10,004,191 | B2 | 6/2018 | Vreugdenhil | |
| 2011/0240309 | A1 * | 10/2011 | Kingma | A62D 1/005 166/369 |
| 2016/0023032 | A1 | 1/2016 | Bowen | |
| 2016/0030793 | A1 | 2/2016 | Xie | |
| 2016/0038778 | A1 | 2/2016 | Siem | |

FOREIGN PATENT DOCUMENTS

| | | | |
|---|---|---|---|
| WO | WO-2011/050980 | | 5/2011 |
| WO | WO-2012/045080 | A1 | 4/2012 |

* cited by examiner

TRIMETHYLGLYCINE AS A FREEZE SUPPRESSANT IN FIRE FIGHTING FOAMS

PRIORITY DATA

This application is a 35 U.S.C. § 371 application of International Application No. PCT/US2014/029276, filed Mar. 14, 2014, which claims the benefit of U.S. Provisional Patent Application No. 61/786,002, filed Mar. 14, 2013, each of which application is incorporated herein by reference in its entirety.

BACKGROUND

Firefighting foam concentrates contain mixtures of surfactants that act as foaming agents, together with solvents and other additives that provide the desired mechanical and chemical properties for the foam. The concentrates are mixed with water in situ and foamed by mechanical means, and the resulting foam is projected onto the fire, typically onto the surface of a burning liquid. The concentrates are typically used at a concentration of about 1-6%.

Aqueous film-forming foam (AFFF) concentrates are designed to spread an aqueous film on the surface of hydrocarbon liquids, which increases the rate at which the fire can be extinguished. This spreading property is made possible by the use of perfluoroalkyl surfactants in AFFF, which produce very low surface tension values in solution (15-20 dynes $cm^{-1}$), thereby permitting the aqueous solution to spread rapidly on the surface of the hydrocarbon liquids.

However, typical AFFF foams are not effective on fires of water-miscible fuels, such as low molecular weight alcohols, ketones, and esters and the like, because the miscibility of the solvent leads to dissolution and destruction of the foam by the fuel. To address this issue, alcohol resistant AFFF (AR-AFFF) concentrates are used, which contain a water-soluble polymer that precipitates on contact with a water-miscible fuel, creating a protective layer between the fuel and the foam. Typical water-soluble polymers used in AR-AFF are polysaccharides, such as xanthan gums. AR-AFFF foams are effective on both hydrocarbon and water-soluble fuels.

Conventional AFFF concentrates contain mixtures of perfluoroalkyl and non-fluorinated surfactants, each of which may be anionic, cationic, nonionic or amphoteric, solvents such as glycols and/or glycol ethers, and minor additives such as chelating agents, pH buffers, corrosion inhibitors and the like. Various AFFF concentrates are described in, for example, U.S. Pat. Nos. 3,047,619; 3,257,407; 3,258,423; 3,562,156; 3,621,059; 3,655,555; 3,661,776; 3,677,347; 3,759,981; 3,772,199; 3,789,265; 3,828,085; 3,839,425; 3,849,315; 3,941,708; 3,957,075; 3,957,657; 3,957,658; 3,963,776; 4,038,198; 4,042,522; 4,049,556; 4,060,132; 4,060,489; 4,069,158; 4,090,976; 4,099,574; 4,149,599; 4,203,850; and 4,209,407. ARAFFF concentrates are described in, for example, U.S. Pat. Nos. 4,060,489; 4,149,599 and 4,387,032.

Foam concentrates often must be stored and used at low temperatures. For example, the concentrate often must be stored outdoors in a cold climate, or it may be stored inside a refrigerated warehouse. Concentrates intended for use under such conditions therefore contain one or more freeze suppressants, that depress the freezing point of the concentrate so that it remains liquid and can be proportioned to make foam. Typically, either propylene glycol or ethylene glycol are used as the freeze suppressant.

SUMMARY OF THE INVENTION

Aqueous film-firefighting composition concentrates are provided containing (a) trimethyl glycine in an amount that is effective to depress the freezing point of the composition below 0° C., (b) an effective amount of at least one surfactant selected from the group consisting of anionic, zwitterionic and nonionic surfactants; and (c) an effective amount of a foam stabilizing agent. The trimethyl glycine may be present in an amount of 0.1 to 60 wt %, for example up to 5%, up to 10%, up to 20%, up to 30%, up to 40%, up to 50% or up to 60 wt %. The foam stabilizing agent may be fluorine containing or may be fluorine free, and may be present in an amount of 0.5-50 wt %.

The concentrate may further contain a first additional anionic, zwitterionic or nonionic surfactant and, optionally, a second additional anionic, zwitterionic or nonionic surfactant. The surfactants present may be of different charge types. The surfactants may be non-fluorinated and/or fluorine-containing surfactants, such as perfluoroalkyl surfactants. The concentrate may contain a high molecular weight water-soluble polymer that precipitates on contact with a water-miscible fuel. In one embodiment, the concentrate may contain or more components such as a corrosion inhibitor, a polymeric foam stabilizer, a biocide.

The concentrate may contain, or may be free of, ethylene glycol and/or propylene glycol. When TMG and a glycol are present, the freezing point of the concentrate is lower than the freezing point of the same concentrate that lacks either trimethyl glycine or the glycol.

The concentrate may contain an alkylpolyglycoside in the amount of 0.3 to 15 wt %. In another embodiment, the concentrate may contain at least one high molecular weight water-soluble polymer, such as a polysaccharide gum and/or acrylic polymer, present in an amount up to 5 wt %.

In one embodiment, the concentrate contains a non-fluorinated surfactant or mixture of non-fluorinated surfactants, and a perfluoroalkyl surfactant or mixture of perfluoroalkyl surfactants, where the non-fluorinated surfactant or mixture of non-fluorinated surfactants is present in an amount of 0.1 to 50 wt %, and the perfluoroalkyl surfactant or mixture of perfluoroalkyl surfactants is present in an amount of 0.3 to 30 wt % and where the foam stabilizing agent is present in an amount of 0.5-50 wt %.

In another embodiment, the concentrate is substantially free of any organofluorine compound, and contains a non-fluorinated surfactant or mixture of non-fluorinated surfactants in an amount of 0.1-65 wt %; a polysaccharide gum in an amount of 0.1-5 wt % and a foam stabilizer is present in an amount of 0.5-50 wt %.

In the present context a composition is substantially free of a component when that component is present, if at all, at trace (impurity) levels that are too low to materially affect the properties of the composition.

The concentrate may contain a fatty alcohol, present in an amount up to 5 wt %. Fatty alcohols in the present context are alcohols having at least 6 carbon atoms, especially having 8-20 carbon atoms and more preferably having 8-16 or 12-14 carbon atoms, and one hydroxyl functionality, i.e. one hydroxyl group per molecule. Preference is given to fatty alcohols with a terminal hydroxyl group, and especially fatty alcohols with straight-chain and saturated alkyl radicals, preferably having more than 6 carbon atoms, especially preferably 8-20 carbon atoms and more preferably 8-16 or 12-14 carbon atoms. Particularly preferred examples of fatty alcohols for use in accordance with the invention are octyl alcohol, lauryl alcohol and myristyl alcohol, including mixtures thereof.

Also provided are fire-fighting foams, containing a concentrate composition as described above, and an aqueous liquid, such as fresh water, brackish water or seawater.

Further provided are methods of making a fire-fighting foam, by foaming a composition as described above with an aqueous liquid, such as fresh water, brackish water or seawater.

Finally, methods of extinguishing a fire are provided in which a foam, prepared as described above, is sprayed on the fire at a rate effective to extinguish the fire.

DETAILED DESCRIPTION

Novel foam concentrate compositions are provided that contain trimethyl glycine ("TMG" or "betaine") as a freeze suppressant, or as a component in a freeze suppressant mixture. Methods of making the concentrates are provided, as are foams made from the concentrates and methods of using these foams for fighting fires. The concentrates have improved resistance to freezing compared to convention concentrates, and also are more environmentally benign.

Conventional fire foam concentrates that are intended to be used at low temperature contain ethylene glycol as a freeze suppressant that keeps the concentrate liquid at reduced temperature. This allows the concentrate to be pumped and proportioned with water to prepare foam. Unfortunately, ethylene glycol is an environmental hazard and its common use in deicing solutions at airports has been reported to result in fish kills and reduced biodiversity as a result of run off. See, for example, "ETHYLENE GLYCOL: Environmental aspects," World Health Organization, Geneva (2000).

TMG has previously been reported to have been used as for lowering the freezing point of aqueous solutions. Thus, for example, TMG solutions have been used for deicing at airports. However, there have not been reports of using TMG as a freeze suppressant in fire foam concentrates. The reason for this is likely the charged zwitterionic nature of the small TMG molecule, which would be expected to behave essentially as a salt in a foam concentrate. Although some salts, such as magnesium sulfate, are used in small quantities in fire foams to change the hardness or softness of the water used to prepare the foam, larger quantities of salts are deleterious to foam performance. In particular, salts decrease the expansion ratio of foam, shorten the foam drain time, and reduce the burn back time. These changes significantly reduce the effectiveness of the foam in extinguishing and securing extinguished fires.

Surprisingly, however, it has been found that TMG can be used to partially or wholly replace ethylene glycol as a freeze suppressant in fire foam concentrates without negatively affecting foam expansion ratios, foam drain time, or burnback time. The TMG can be used in any type of foam concentrate used for preparing fire foams, including simple surfactant foams, AFFF and AR-AFFF foams. The TMG can be present in the amount desired to provide the necessary depression of the freezing point of the mixture. One skilled in the art will recognize that TMG can readily be added to concentrates in incremental amounts and the effect on freezing point measured, allowing the determination of the wt % of TMG required. TMG can be used in amounts of 0.1 to 60 wt % of concentrates, for example, up to 1%, up to 5%, up to 10%, up to 15%, up to 20%, up to 25%, up to 30%, up to 35%, up to 40%, up to 45%, up to 50%, up to 55%, or up 60%. Typically TMG is present in an amount that depresses the freezing point of the concentrate below 0° C., advantageously below −10° C., −20° C., −30° C. or −40° C.

Also surprisingly, it has been found that combinations of TMG and ethylene glycol and/or propylene glycol in foam concentrates have a synergistic effect in lowering the freezing point of a concentrate more effectively than either TMG or a glycol alone. This can be useful especially for concentrates that must be used in extreme cold. In fact, combinations of TMG and ethylene glycol have been shown to depress the freezing point of concentrates to approximately −70° C. In these synergistic combinations, the TMG may be present in amounts up to 50 wt % and the glycol may be present in amounts up to 70 wt %. Exemplary combinations of TMG/glycol include, but are not limited to (figures in wt %): 5/10, 50/10, 5/70, 20/70, 50/40, 35/55, 27.5/10, 5/40, 12.5/70, 50/25, 26/40, 15.5/25, 38/25, 15.5/55, 23/55, and 38/40. Typically the ratio of TMG to glycol varies from 1:2 to 2:1, although ratios outside these limits also can be used as desired.

In addition, many fire foam concentrates contain diethylene glycol monobutyl ether (butyl carbitol) as a foam stabilizing solvent. Unfortunately, it has been shown that the presence of diethylene glycol monobutyl ether in a solution makes it incompatible with TMG, rendering it insoluble. It has been found, however, that adding one or more alkyl sulfate detergents, such as octyl and/or decyl sulfates, overcomes this problem, even when the alkyl sulfate is present in small amounts.

Foam Concentrates Containing TMG

As described above, TMG and synergistic TMG/glycol combinations can be used in essentially any foam concentrate, including simple concentrates, AFFF, and AR-AFFF concentrates. It may also be used in fluorine-free foam concentrates such as those described, for example, in WO 2011/050980. As described above, when a concentrate contains TMG it has been found to be advantageous to include at least sufficient alkyl sulfate surfactant to ensure that the diethylene glycol monobutyl ether is fully soluble in the concentrate.

The concentrates may be produced at any suitable strength, including, but not limited to, 1, 3 and 6% (w/w) foam concentrates, which are concentrations that are typical for commercial use. Concentrates that are less than 1% (w/w) or greater than 6% (w/w) also may be prepared. As used herein, the lowest numbered strength for the concentrate used indicates the most concentrated product, i.e., the percent designation refers to the proportioning rate of foam concentrate to water. Accordingly, one part 1% concentrate used with 99 parts water gives 100 parts of use strength pre-mix; similarly, three parts 3% concentrate and 97 parts water gives 100 parts of pre-mix. As used herein, the term "water" may include pure, deionized or distilled water, tap or fresh water, sea water, brine, or an aqueous or water-containing solution or mixture capable of serving as a water component for the fire fighting composition.

Typical components used for preparing AFFF and AR-AFFF concentrates are shown in the table below, together with typical % concentrations (w/w).

| Component | % by weight |
|---|---|
| High MW fluorinated polymer (HMW-FP) | 0.2-15 |
| Amphoteric Hydrocarbon Surfactant | 0-10 |
| Anionic Hydrocarbon Surfactant | 0-10 |

-continued

| Component | % by weight |
|---|---|
| Nonionic Hydrocarbon surfactant | 0-10 |
| Fluorochemical Surfactant | 0-10 |
| Foam aids including glycol ethers | 0-15 |
| Sequestering, buffer, corrosion package | 0-5 |
| Polymeric film formers | 0-5 |
| Biocides, antimicrobial | 0-0.05 |
| Electrolytes | 0-5 |
| Polymeric foam stabilizers and thickeners | 0-10 |
| Water | to 100% |

The above components would be reduced or increased accordingly relative to the 3% liquid concentrate to prepare 6% and 1% synthetic liquid foam concentrates, or other concentrate levels. Thus, for a 1% concentrate, the above amounts may be increased by a factor of 3, whereas for a 6% concentrate the above amounts may be reduced by half.

Fluoropolymer Component

High molecular weight fluoropolymers may be used in an amount to provide a foam concentrate that may have from about 0.005% or less to about 6% or more fluorine by weight of concentrate, more typically from about 0.01% to about 4.5% fluorine by weight of concentrate.

Hydrocarbon Surfactants

Zwitterionic or amphoteric hydrocarbon surfactants include, but are not limited to, those which contain in the same molecule, amino and carboxy, sulfonic, and sulfuric ester moieties and the like. Higher alkyl ($C_6$-$C_{14}$) betaines and sulfobetaines are included in this category. Commercially available products include Chembetaine CAS (Lubrizol Inc.) and Mirataine CS (Rhodia), both sulfobetaines, and Deriphat 160C (BASF), a $C_{12}$ amino-dicarboxylate. These products are foaming agents and help reduce interfacial tension in water solution.

Anionic hydrocarbon surfactants include, but are not limited to, alkyl carboxylates, sulfates, sulfonates, and their ethoxylated derivatives. Alkali metal and ammonium salts are suitable. $C_8$-$C_{16}$ hydrocarbon surfactants are suitable, including, advantageously, $C_8$-$C_{10}$.

Nonionic hydrocarbon surfactants help reduce interfacial tension and solubilize other components, especially in hard water, sea water or brine solutions. They also serve to control foam drainage, foam fluidity, and foam expansion. Suitable nonionic surfactants include, but are not limited to, polyoxyethylene derivatives of alkylphenols, linear or branched alcohols, fatty acids, alkylamines, alkylamides, and acetylenic glycols, alkyl glycosides and polyglycosides, as defined in U.S. Pat. No. 5,207,932 (herein incorporated by reference) and others, and block polymers of polyoxyethylene and polyoxypropylene units.

In the present context, one of ordinary skill in the art will understand that reference to surfactants of different charge types refers to, for example, anionic and non-ionic surfactants, or anionic and zwitterionic surfactants.

Fluorocarbon Surfactants

Fluorochemical surfactants are typically single perfluorotail molecules and may have multiple hydrophilic heads. Advantageously, the fluorochemical surfactant contains perfluoroalkyl groups no longer than $C_6$, although $C_8$ and longer fluorosurfactants can also be used. Examples of suitable fluorochemical surfactants include those described in WO/2012/045080. The quantity of fluorochemical surfactant(s) may be added to increase extinguishing speed and burnback resistance.

Foam Aids

Foam aids may be used to enhance foam expansion and drain properties, while providing solubilization and anti-freeze action. Useful foam aids are well known in the art and are disclosed, for example, in U.S. Pat. Nos. 5,616,273, 3,457,172; 3,422,011 and 3,579,446, which are herein incorporated by reference.

Typical foam aids include alcohols or ethers such as ethylene glycol monoalkyl ethers, diethylene glycol monoalkyl ethers, propylene glycol monoalkyl ethers, dipropylene glycol monoalkyl ethers, triethylene glycol monoalkyl ethers, 1-butoxyethoxy-2-propanol, glycerine, and hexylene glycol.

Sequestering, Buffer, and Corrosion Package

The components of the sequestering, buffer, and corrosion package, include agents that sequester and chelate metal ions. Examples include polyaminopolycarboxylic acids, ethylenediaminetetraacetic acid, citric acid, tartaric acid, nitrilotriacetic acid, hydroxyethylethylenediaminetriacetic acid and salts thereof. Buffers are exemplified by Sorensen's phosphate or McIlvaine's citrate buffers. The nature of the corrosion inhibitors is limited only by compatibility with other formula components. Typical corrosion inhibitors include ortho-phenylphenol, tolyltriazole, and many phosphate ester acids.

Polymeric Film Former

These water-soluble polymeric film formers, dissolved in AR-AFFF agents, precipitate from solution when the bubbles contact polar solvents and fuel, and form a vapor-repelling polymer film at the solvent/foam interface, preventing further foam collapse. Examples of suitable compounds include thixotropic polysaccharide gums as described in U.S. Pat. Nos. 3,957,657; 4,060,132; 4,060,489; 4,306,979; 4,387,032; 4,420,434; 4,424,133; 4,464,267, 5,218,021, and 5,750,043, which are herein incorporated by reference. Suitable commercially available compounds are marketed as Rhodopol, Keltrol, Actigum, Cecal-gum, Galaxy, and Kelzan.

Gums and resins useful as film formers include acidic gums such as xanthan gum, pectic acid, alginic acid, agar, carrageenan gum, rhamsam gum, welan gum, mannan gum, locust bean gum, galactomannan gum, pectin, starch, bacterial alginic acid, succinoglucan, gum arabic, carboxymethylcellulose, heparin, phosphoric acid polysaccharide gums, dextran sulfate, dermantan sulfate, fucan sulfate, gum karaya, gum tragacanth and sulfated locust bean gum.

Neutral polysaccharides useful as film formers include: cellulose, hydroxyethyl cellulose, dextran and modified dextrans, neutral glucans, hydroxypropyl cellulose, as well, as other cellulose ethers and esters. Modified starches include starch esters, ethers, oxidized starches, and enzymatically digested starches.

Antimicrobials and Preservatives

These components may be used to prevent biological decomposition of natural product based polymers incorporated as polymeric film formers. Examples include Kathon CG/ICP (Rohm & Haas Company) and Givgard G-4 40 (Givaudan, Inc.), and are disclosed in U.S. Pat. No. 5,207,932, which is herein incorporated by reference. Additional preservatives are disclosed in U.S. Pat. Nos. 3,957,657; 4,060,132; 4,060,489; 4,306,979; 4,387,032; 4,420,434; 4,424,133; 4,464,267, 5,218,021, and 5,750,043.

Electrolytes

Electrolytes may be added to AFFF's and AR-AFFF agents in small amounts to balance the performance of such agents when proportioned with water ranging from soft to very hard, including sea water or brine, and to improve agent performance in very soft water. Typical electrolytes include salts of monovalent or polyvalent metals of Groups 1, 2, or 3, or organic bases. The alkali metals particularly useful are sodium, potassium, and, or the alkaline earth metals, especially magnesium. Organic bases might include ammonium, trialkylammonium, bis-ammonium salts or the like. The anions of the electrolyte are not critical, except that halides may not be desirable due to metal corrosion. Sulfates, bisulfates, phosphates, nitrates and the like are commonly used. Examples of polyvalent salts include magnesium sulfate and magnesium nitrate.

Polymeric Foam Stabilizers and Thickeners

These components can be optionally incorporated to enhance the foam stability and foam drainage properties. Examples of polymeric stabilizers and thickeners include partially hydrolyzed protein, starches, polyvinyl resins such as polyvinyl alcohol, polyacrylamides, carboxyvinyl polymers, polyvinyl polypyrrolidone, and poly(oxyethylene) glycol.

TMG and TMG/glycol mixtures of the type described herein may be used with commercially available synthetic surfactant concentrates to prepare foam concentrates. The commercially available surfactant concentrates are marketed worldwide and include those available from Solberg, Kidde, and Tyco. These products include: Class A foams (CLASS A PLUS and SILVEX), excellent for extinguishing forest fires, structural fires, and tire fires; high expansion foams sold under the names JET-X, EXTRA, C2, and VEE-FOAM; vapor suppressant foam sold by Chemguard as VRC foam; bomb foam, a 6% product sold by Chemguard as AFC-380.

Synthetic surfactant concentrates listed as "wetting agents" by Underwriters Laboratory may also be included as base surfactant mixtures for preparing AR-AFFF concentrates. Products listed by UL as "wetting agents" are as follows: Fire Strike by Biocenter Inc.; Bio-Fire by Envirorenu Technologies LLC; Enviro-Skin 1% by Environmental Products Inc.; F-500 by Hazard Control Technologies Inc.; Knockdown by National Foam Inc.; Phos-Chek WD881 by Solutia Inc.; Flameout by Summit Environmental Corp. Inc. Micro-Blazeout by Verde Environmental Inc.; Bio-solve by Westford Chemical Corp.

Exemplary concentrate formulations are shown below. These formulations are not limiting of the range of components that can be used in foam concentrates containing TMG, nor are they limiting of the amounts and relative proportions of the components. When an exemplary formulation specifies, a component it will be understood that the specified component can be a mixture of such components. Thus, for example, when the formulations below specify an anionic surfactant, this represents one or more anionic surfactants. Surfactants can be perfluoroalkyl-containing surfactants or non-fluorinated surfactants, if not specifically identified.

AFFF Formulation:

| | |
|---|---|
| Anionic Surfactant | 3% |
| Nonionic Surfactant | 5% |
| Zwitterionic Surfactant | 2% |
| Solvent | 15% |
| Trimethylglycine | 25% |
| Corrosion Inhibitor | 0.1% |
| Bactericide | 0.1% |
| Water | To 100% |

AR-AFFF Formulation

| | |
|---|---|
| Anionic Surfactant | 3% |
| Nonionic Surfactant | 5% |
| Zwitterionic Surfactant | 2% |
| Solvent | 15% |
| Trimethylglycine | 25% |
| Biopolymer/Polymer | 1% |
| Corrosion Inhibitor | 0.1% |
| Bactericide | 0.1% |
| Water | To 100% |

Use of TMG and TMG/Glycol-Containing Concentrates

Concentrate prepared as described above may be mixed with water, typically as a 3% solution, and foamed using foaming devices well known in the art. As water under pressure passes through a fire hose, typically 3 percent by volume of the concentrate composition is inducted into the hose line by the Venturi effect to form a foam solution of the concentrate diluted with water. The solution becomes aerated to produce a finished foam by use of an air-aspirating nozzle located at the outlet end of the hose. A foam solution stored for any length of time prior to aeration is known as a foam premix and can likewise be aerated to produce a finished foam. Equipment which can be used to produce and apply these aqueous air-foams are known in the art and also are described in publications by the National Fire Protection Association.

The concentrate, upon dilution with water and aeration, produces an aqueous film-forming foam which is applied to a body of flammable liquid such as a spill or pool which is burning or subject to ignition. The foam extinguishes the burning liquid, and prevents further ignition by providing a blanket to cover the fuel surface and excluding air.

Preferably, the compositions are introduced into a fire or flame in an amount sufficient to extinguish the fire or flame. One skilled in the art will recognize that the amount of extinguishing composition needed to extinguish a particular hazard will depend upon the nature and extent of the hazard.

Fire Test Results

Formulations similar to the AR-AFFF formulation above, but containing 30 wt % TMG were tested in a standard UL-162 Type III test. Foams were prepared at 3% in both fresh water and salt water, and the results are shown below:

3% in Fresh Water

Fire Extinguishment time: 1 minute 30 seconds

Burn Back Resistance: 16% @ 8 minutes

Expansion Ratio: 6.64

Drain Time: 4 minutes 30 seconds

3% in Salt Water

Fire Extinguishment time: 2 minutes 5 seconds

Burn Back Resistance: 14% @ 8 minutes

Expansion Ratio: 6.06

Drain Time: 3 minutes 43 seconds

As described above, typically when large amounts of salt are added to a formulation this decreases burn back time, significantly lowers the foam expansion ratio, and significantly shortens the foam drain time. However, these results above show that TMG present at a concentration of 30% had no statistically significant detrimental effect on the foam.

TMG and TMG/glycol containing foam concentrates can be tested under the following well-known standards:

UL-162 Underwriters Laboratory test

EN-1568 European fire test standard

IMO 1312 Maritime Organization Fire test Standard

LastFire "Large Atmospheric Storage Tank Fires"—oil industry standard test

MIL-F-24385F United States military specification

What is claimed is:

1. A fire-fighting foam comprising:

(a) 0.25 wt %-3.6 wt % trimethyl glycine;

(b) at least one surfactant selected from the group consisting of anionic, zwitterionic and nonionic surfactants;

(c) a foam stabilizing agent; and (d) an aqueous liquid;

wherein the fire-fighting foam is formed by foaming an aqueous firefighting foam concentrate that has been diluted with the aqueous liquid; and the aqueous fire-fighting foam concentrate contains the trimethyl glycine in an amount that is effective to depress the freezing point of said concentrate below 0° C.

2. The fire-fighting foam according to claim 1, wherein said aqueous liquid is made from brackish water or seawater.

3. A method of making a fire-fighting foam, comprising foaming a foam concentrate composition with an aqueous liquid to form the fire-fighting foam, wherein the foam concentrate composition comprises:

(a) trimethyl glycine in an amount that is effective to depress the freezing point of said foam concentrate composition below 0° C.;

(b) at least one surfactant selected from the group consisting of anionic, zwitterionic and nonionic surfactants; and (c) a foam stabilizing agent;

wherein the fire-fighting foam includes 0.25 wt %-3.6 wt % of the trimethyl glycine.

4. The method according to claim 3, wherein said aqueous liquid is brackish water or seawater.

5. A method of extinguishing a fire comprising spraying a foam according to claim 1 on the fire at a rate effective to extinguish said fire.

6. The fire-fighting foam according to claim 1, further comprising a first additional anionic, zwitterionic or nonionic surfactant.

7. The fire-fighting foam according to claim 6, further comprising a second additional anionic, zwitterionic or nonionic surfactant.

8. The fire-fighting foam according to claim 6, wherein said at least one surfactant and said first additional surfactant are of different charge types.

9. The fire-fighting foam according to claim 7, wherein said at least one surfactant and said first and second additional surfactants are of different charge types.

10. The fire-fighting foam according to claim 1, further comprising a high molecular weight water-soluble polymer that precipitates on contact with a water-miscible fuel.

11. The fire-fighting foam according to claim 1, further comprising a corrosion inhibitor.

12. The fire-fighting foam according to claim 1, wherein said foam stabilizing agent is a polymeric foam stabilizer.

13. The fire-fighting foam according to claim 1, further comprising a biocide.

14. The fire-fighting foam according to claim 1, wherein at least one surfactant is a non-fluorinated surfactant.

15. The fire-fighting foam according to claim 1, wherein all surfactants are non-fluorinated surfactants.

16. The fire-fighting foam according to claim 1, further comprising a zwitterionic or anionic perfluoroalkyl surfactant.

17. The fire-fighting foam according to claim 1, wherein the foam is free of ethylene glycol and propylene glycol.

18. The fire-fighting foam according to claim 1, further comprising at least one high molecular weight water-soluble polymer.

19. The fire-fighting foam according to claim 18, wherein the polymer is a polysaccharide gum present in an amount up to 5 wt %.

20. The fire-fighting foam according to claim 18, wherein the polymer is an acrylic polymer present in an amount up to 5 wt %.

21. The fire-fighting foam according to claim 1, wherein the foam further comprises glycerine.

22. The fire-fighting foam according to claim 1, wherein the foam stabilizing agent is fluorine free.

23. The fire-fighting foam of claim 1, wherein the at least one surfactant comprises anionic surfactant, zwitterionic surfactant, and nonionic surfactant.

24. The fire-fighting foam of claim 1 wherein the at least one surfactant comprises:

an anionic surfactant comprising $C_8$-$C_{16}$ alkyl sulfate and/or $C_8$-$C_{16}$ alkyl sulfonate;

a zwitterionic surfactant comprising $C_6$-$C_{14}$ alkyl betaine and/or $C_6$-$C_{14}$ alkyl sulfobetaine; and a nonionic surfactant comprising an alkyl polyglycoside.

25. The fire-fighting foam of claim 1, wherein the fire-fighting foam further comprises ethylene glycol and/or propylene glycol.

26. A fire-fighting foam comprising:

(a) 0.25 wt %-3.6 wt % trimethyl glycine;

(b) anionic surfactant;

(c) zwitterionic surfactant;

(d) nonionic surfactant;

(e) polymeric foam stabilizing agent; and (f) an aqueous liquid.

27. The fire-fighting foam of claim 26, wherein an anionic surfactant comprises $C_8$-$C_{16}$ alkyl sulfate and/or $C_8$-$C_{16}$ alkyl sulfonate, the zwitterionic surfactant comprises $C_6$-$C_{14}$ alkyl betaine and/or $C_6$-$C_{14}$ alkyl sulfobetaine, and the nonionic surfactant comprises an alkyl polyglycoside.

28. A method of making a fire-fighting foam, comprising foaming a foam concentrate composition with an aqueous liquid to form the fire-fighting foam, wherein the foam concentrate composition comprises:

(a) trimethyl glycine in an amount that is effective to depress the freezing point of said foam concentrate composition below 0° C.;

(b) 0.1 to 10 wt % anionic surfactant;

(c) 0.1 to 10 wt % zwitterionic surfactant;

(d) 0.3 to 15 wt % nonionic surfactant; and (e) 0.5-50 wt % foam stabilizing agent;

wherein the fire-fighting foam includes 0.25 wt %-3.6 wt % of the trimethyl glycine.

29. The method of claim 28, wherein the foam concentrate composition comprises 5 to 60 wt % of the trimethyl glycine.

* * * * *